US010816290B2

(12) United States Patent
Greene

(10) Patent No.: US 10,816,290 B2
(45) Date of Patent: Oct. 27, 2020

(54) SYSTEM AND METHOD FOR LOADING CLIPS

(71) Applicant: Powdered Ballistics LLC, Glenwood, MN (US)

(72) Inventor: Leonard Greene, Glenwood, MN (US)

(73) Assignee: Powdered Ballistics LLC, Glenwood, MN (US)

( * ) Notice: Subject to any disclaimer, the term of this patent is extended or adjusted under 35 U.S.C. 154(b) by 0 days.

(21) Appl. No.: 16/556,677

(22) Filed: Aug. 30, 2019

(65) Prior Publication Data

US 2020/0158455 A1 May 21, 2020

Related U.S. Application Data

(60) Provisional application No. 62/725,443, filed on Aug. 31, 2018.

(51) Int. Cl.
*F41A 9/85* (2006.01)

(52) U.S. Cl.
CPC ..... *F41A 9/85* (2013.01)

(58) Field of Classification Search
CPC ..... F41A 9/85
USPC ..... 42/87–89
See application file for complete search history.

(56) References Cited

U.S. PATENT DOCUMENTS 2,508,820 A * 5/1950 Fraley ..... F41A 9/85 206/3
2,526,195 A * 10/1950 Brownsey ..... F42B 39/26 206/3
2,920,893 A 1/1960 Walker
3,208,350 A * 9/1965 Robinson ..... F41A 9/64 89/34
3,757,449 A * 9/1973 Schindler ..... F41A 9/83 42/87
4,015,358 A * 4/1977 Amos ..... F41A 9/83 42/87
4,027,417 A 6/1977 Swatek
4,038,771 A * 8/1977 Miller ..... F41A 9/85 42/70.11
4,492,051 A * 1/1985 Switzer ..... F41A 9/85 42/87
4,502,239 A * 3/1985 Laguna ..... F42B 39/002 42/87

(Continued)

FOREIGN PATENT DOCUMENTS

GB 2484328 A 4/2012

OTHER PUBLICATIONS

Scott W. Wagner, "5 Star Firearms Billet Aluminum Precision Revolver Speedloaders," www.usconcealedcarry.com [online]; USCCA—Aug. 2, 2020, Retrieved from the Internet:<Url: https://www.usconcealedcarry.com/blog/5-star-firearms-billet-aluminum-precision-revolver-speedloaders/>; 1-10pgs.

(Continued)

*Primary Examiner* — Samir Abdosh
(74) *Attorney, Agent, or Firm* — Mueting Raasch Group

(57) ABSTRACT

A system for loading pellets into clips includes a clip plate defining a plurality of clip openings; a pellet plate with pellet openings; a loading plate with loading pegs; and a base with a base plate surrounded by a base wall, the base plate and base wall defining a base cavity constructed to accept the clip plate, the pellet plate, and the loading plate in more than one axial orientation.

16 Claims, 6 Drawing Sheets

(56) References Cited

U.S. PATENT DOCUMENTS

| | | | | |
|---|---|---|---|---|
| 4,574,511 | A * | 3/1986 | Csongor | F41A 9/84<br>42/87 |
| 9,239,199 | B2 * | 1/2016 | Martin | F41A 9/85 |
| 10,533,817 | B1 * | 1/2020 | Hefer | F41A 9/83 |
| 2015/0369552 | A1 * | 12/2015 | Earl | F41A 9/85<br>42/89 |
| 2020/0025481 | A1 * | 1/2020 | Mokuolu | F41A 9/83 |
| 2020/0049438 | A1 * | 2/2020 | Hatch | F41A 9/67 |

OTHER PUBLICATIONS

Scroefer, "Speedloader for Umarex round 8-pellet magazin V2," www.thingiverse.com [online]; Feb. 2, 2018, Retrieved from the Internet:<URL:https:thingiverse.com/thing:2779249>; 1-3pgs.

PyramydAir Gun Mall, "Air Venturi Diabolo Speedloader (.177)," www.pyramydair.com [online]; Feb. 2, 2017, Retrieved from the Internet:<URL:https://www.pyramydair.com/s/a/Air_Venturi_Diabolo_Speedloader_177/156>; 1-2pgs.

* cited by examiner

SECTION A-A

SECTION A-A

SECTION B-B

SECTION B-B

DETAIL A

SYSTEM AND METHOD FOR LOADING CLIPS

RELATED APPLICATIONS

This application claims the benefit of U.S. Provisional Application No. 62/725,443, filed Aug. 31, 2018, the disclosure of which is incorporated by reference herein in its entirety.

FIELD

The present disclosure relates to systems and methods used for loading clips. In particular, the present disclosure relates to systems and methods used for loading ammunition into clips used in guns.

BACKGROUND

Certain types of guns, such as air guns including air rifles, utilize clips or magazines loaded with a plurality of pellets. The clips typically have a generally round disk shape and include pockets or openings that accept pellets. Loading or reloading clips with pellets can be slow and cumbersome. Various devices have been proposed to make loading the clips easier and faster.

It would be desirable to provide a system and method for loading clips that is faster or more convenient. It would further be desirable to provide a system that is easier and/or cheaper to manufacture and easier to assemble.

SUMMARY

A system for loading pellets into clips includes a clip plate defining a plurality of clip openings and an alignment feature within each clip opening constructed to receive a clip in a fixed alignment; a pellet plate defining pellet openings arranged in a plurality of circles aligned with the plurality of clip openings of the clip plate; a loading plate comprising loading pegs aligned with the pellet openings of the pellet plate; a center axis extending through the clip plate, the pellet plate, and the loading plate when in a stacked configuration; and a base comprising a base plate surrounded by a base wall, the base plate and base wall defining a base cavity constructed to accept the clip plate, the pellet plate, and the loading plate in more than one axial orientation.

A method for loading pellets into clips includes placing one or more clips in clip openings of a clip plate within a base cavity, the clip comprising pockets; placing a pellet plate on top of the clip plate within the base cavity, the pellet plate defining pellet openings aligned with the pockets of the clip; loading pellets into the pellet openings; and pressing a loading plate into the base cavity, the loading plate comprising loading pegs that load the pellets into the pockets of the one or more clips. A center axis extends through the clip plate, the pellet plate, and the loading plate when in a stacked configuration. The base includes a base cavity constructed to accept the clip plate, the pellet plate, and the loading plate in more than one axial orientation.

DETAILED DESCRIPTION

Figure 1B:
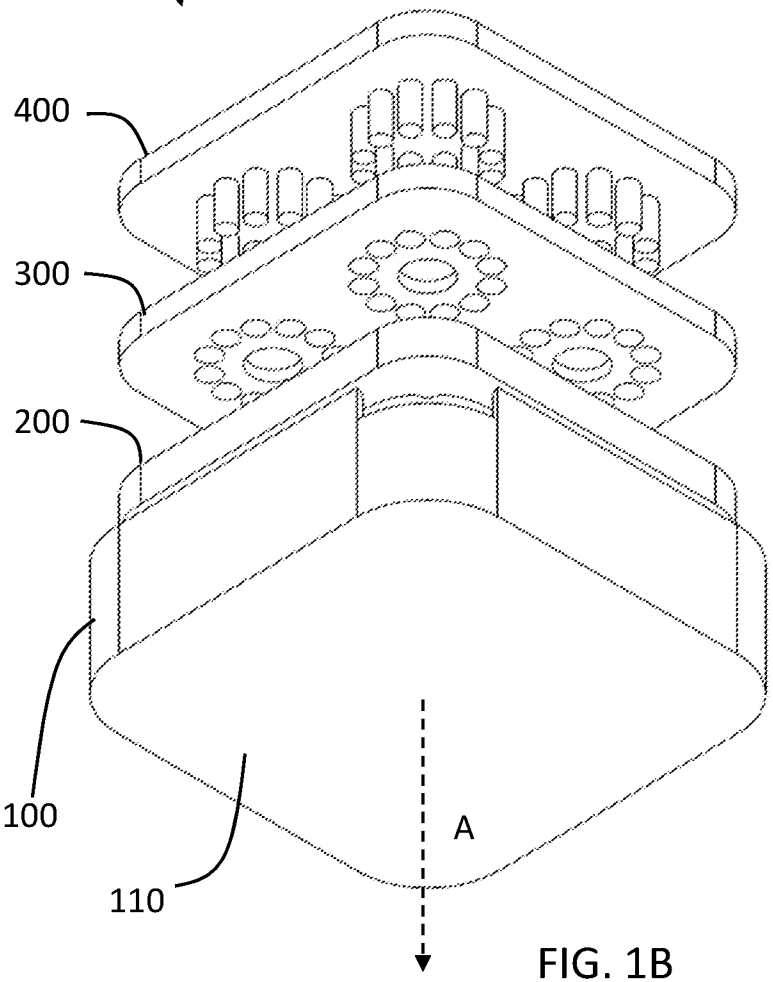
FIG. 1B is a bottom perspective view of the loader system of FIG. 1A.

The present disclosure relates to systems and methods used for loading clips. In particular, the present disclosure relates to systems and methods used for loading clips used in guns.

According to an embodiment, the system includes a clip loader that can be used to load ammunition in to a clip. The clip loader may be loaded with one or more clips, up to the number of clip receptacles or openings in the clip loader. Clips placed in the clip loader can be loaded simultaneously with ammunition using the clip loader. Suitable clips include those used with, for example, air rifles. The clips may have a generally round disk shape with a plurality of pockets or openings along the perimeter for accepting the ammunition. The number of pockets in the clip may vary and is typically between 6 and 14, with 8, 10, and 12-round clips being most common. The ammunition may be referred to as pellets, shot, "BB's", etc. The clip may include a loading side (e.g., a front side) through which the pellets are intended to be loaded into the pockets, and an opposing back side. The clips may have a scalloped outer perimeter around the pockets. Typically, the scalloping generally follows the shape of the pockets on the clip. The scalloping may extend from one side of the clip to a part of the thickness of the clip. For example, the scalloping may extend from the back side to part of the way toward the loading side.

The term "ammunition" is used in this disclosure to describe any projectiles that may be loaded in the clip. Typical ammunition used with the clips may include pellets, shot, "BB's", and the like, of any suitable caliber.

The term "caliber" is used here to refer to the size of a projectile (e.g., pellet or shot). Caliber may be given as a numeric value (e.g., 0.170 caliber), referring to the diameter of the projectile in inches, unless otherwise specified.

Terms such as "a," "an," and "the" are not intended to refer to only a singular entity but include the general class of which a specific example may be used for illustration.

The terms "a," "an," and "the" are used interchangeably with the term "at least one." The phrases "at least one of" and "comprises at least one of" followed by a list refers to any one of the items in the list and any combination of two or more items in the list.

As used here, the term "or" is generally employed in its usual sense including "and/or" unless the content clearly dictates otherwise. The term "and/or" means one or all of the listed elements or a combination of any two or more of the listed elements.

The term "substantially" as used here has the same meaning as "significantly," and can be understood to modify the term that follows by at least about 75%, at least about 90%, at least about 95%, or at least about 98%. The term "not substantially" as used here has the same meaning as "not significantly," and can be understood to have the inverse meaning of "substantially," i.e., modifying the term that follows by not more than 25%, not more than 10%, not more than 5%, or not more than 2%.

The term "about" is used here in conjunction with numeric values to include normal variations in measurements as expected by persons skilled in the art, and is understood have the same meaning as "approximately" and to cover a typical margin of error, such as ±5% of the stated value.

The recitations of numerical ranges by endpoints include all numbers subsumed within that range (e.g., 1 to 5 includes 1, 1.5, 2, 2.75, 3, 3.80, 4, 5, etc. or 10 or less includes 10, 9.4, 7.6, 5, 4.3, 2.9, 1.62, 0.3, etc.). Where a range of values is "up to" or "at least" a particular value, that value is included within the range.

The words "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Figure 1A:
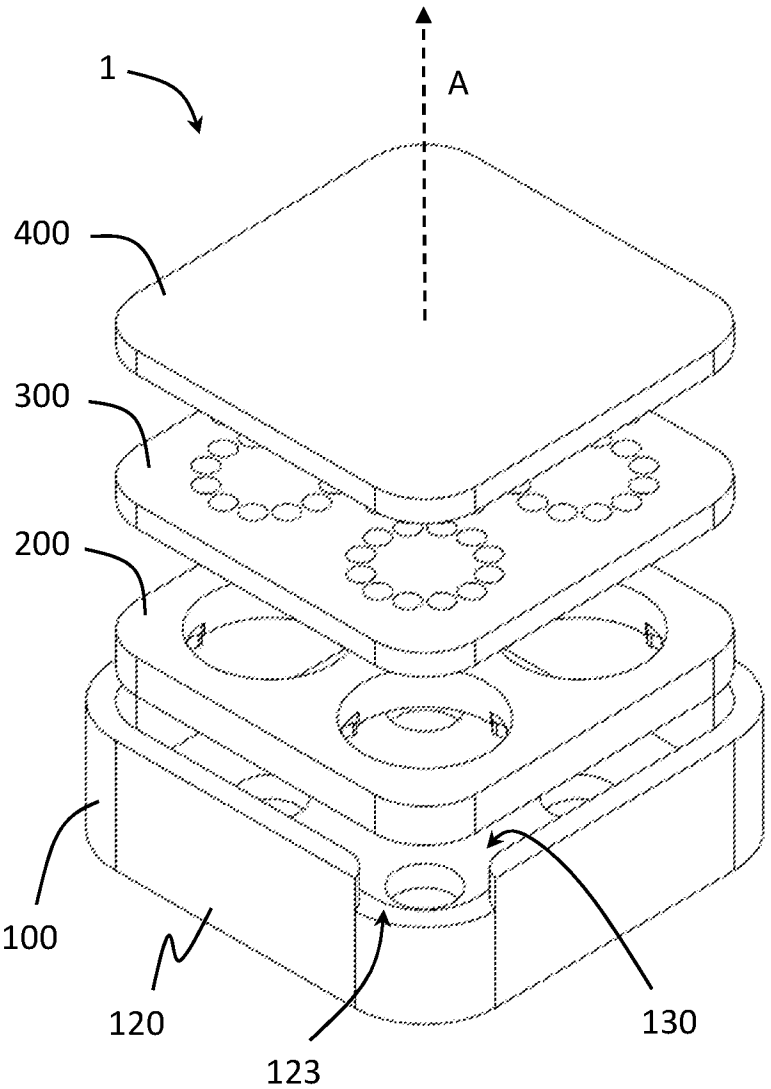
FIG. 1A is a top perspective view of a loader system according to an embodiment.

Referring now to FIGS. 1A and 1B, perspective views of a system according to an embodiment are shown. The system may be referred to as a loader 1 or clip loader. The loader 1 includes a base 100. The base 100 includes, at least, a base plate 110 surrounded by a base wall 120. The base plate 110 and the base wall 120 define a base cavity 130. The base cavity 130 is constructed to receive a clip plate 200, a pellet plate 300, and a loading plate 400. According to an embodiment, the base cavity 130 can accept the clip plate 200, the pellet plate 300, and the loading plate 400 in more than one axial orientation. The term "axial orientation" is used here to refer to an axially rotational alignment or position. The axial orientation of a plate may be changed by rotating the plate about its center axis A.

As shown in FIGS. 1A and 1B, the order of the various parts accepted by the base 100 is first the clip plate 200, then the pellet plate 300, and finally the loading plate 400. In some embodiments, the clip plate 200 is integral with the base 100.

Figure 2:
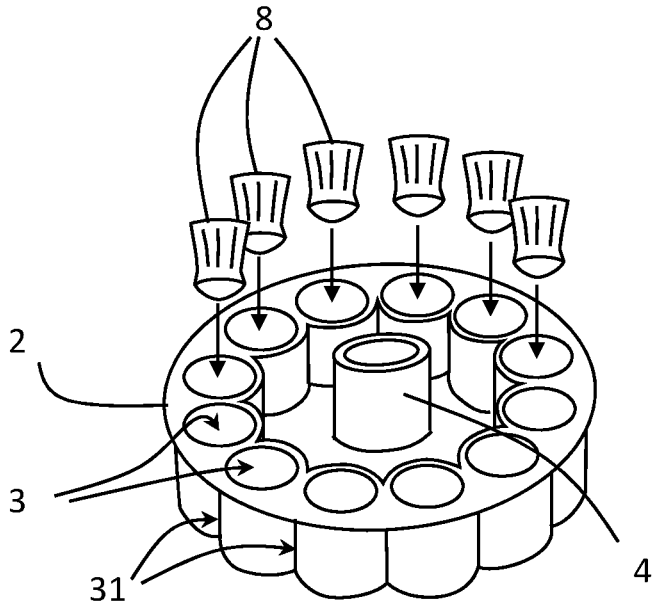
FIG. 2 is a schematic perspective view of an exemplary clip and pellets.

FIG. 2 shows a schematic perspective view of an exemplary clip 2 and pellets 8 that can be loaded using the loader 1. The clip 2 includes a plurality of pockets 3 for receiving pellets 8. Only six pellets are shown. However, the clip 2 is typically loaded such that each pocket receives one pellet 8. The clip 2 may have a scalloped outside perimeter surrounding the pockets 3 that forms indentations 31 between the pockets 3. The clip may include a central protrusion 4 axially protruding from one or both faces of the clip.

Figure 3B:
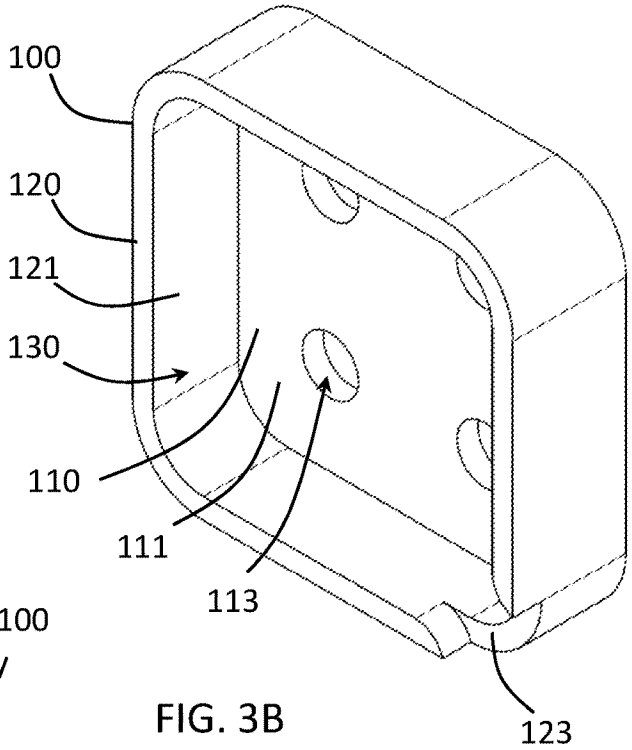
FIG. 3B is a side perspective view of the base of FIG. 3A.
Figure 3A:
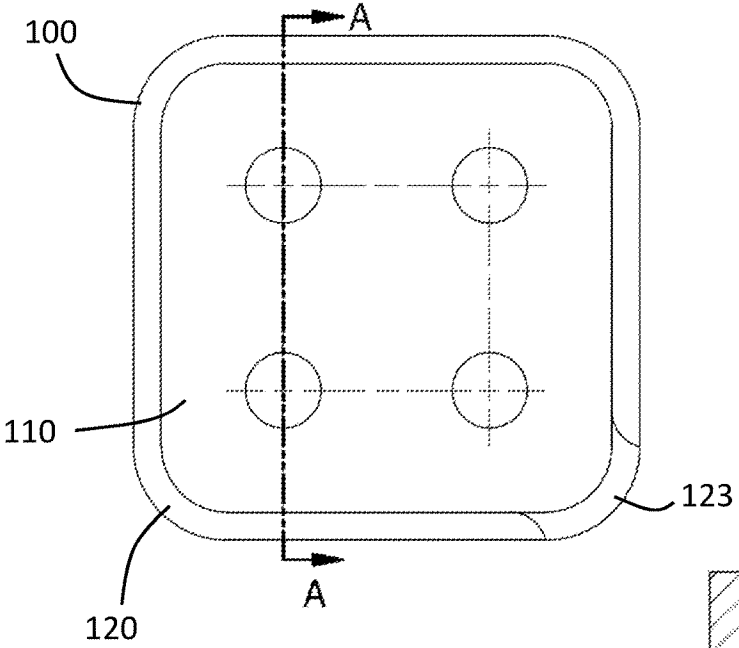
FIG. 3A is a plan view of a base for the loader system of FIG. 1A according to an embodiment.
Figure 3C:
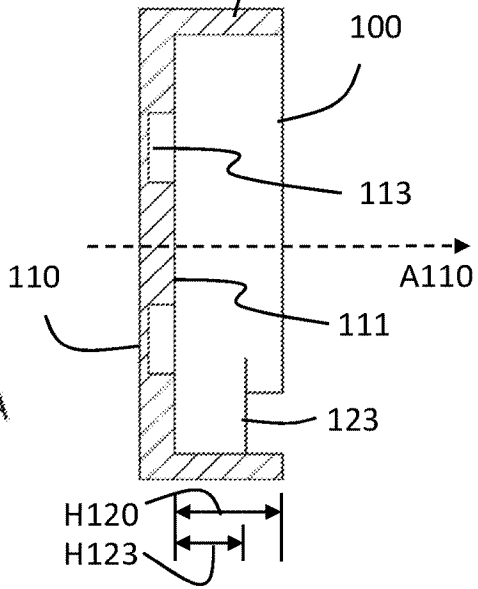
FIG. 3C is a cross-sectional side view of base plate of FIG. 3A.

FIGS. 3A-3C show various views of the base 100. The base 100 includes a base plate 110 with an inside surface 111. The base plate 110 is at least partially surrounded by a base wall 120. The base wall 120 has an inside surface 121. The inside surface 111 of the base plate 110 and the inside surface 121 of the base wall 120 define a cavity 130 inside the base 100. In embodiments where the clip plate 200 is integral with the base 100, the top surface (e.g., first major surface 201) of the clip plate 200 and the inside surface 121 of the base wall 120 define the cavity 130. The cavity is sized and shaped to receive the clip plate 200, the pellet plate 300, and the loading plate 400.

The base wall 120 may optionally include an indentation or notch 123. The notch 123 is an indentation in the base wall 120 in an axial direction perpendicular to the plane of the base plate inside surface 111. The notch 123 is an area where the base wall 120 is lower than in the surrounding areas. The base wall 120 has generally a height H120. However, at the notch 123, the base wall 120 has a height H123 that is lower than the height H120 in the areas surrounding the notch 123. The height H120 may be equal or substantially equal to the combined height of the clip plate 200, the pellet plate 300, and the loading plate 400. The height H123 at the notch 123 may be equal or substantially equal to the combined height of the clip plate 200 and the pellet plate 300. When the clip plate 200, the pellet plate 300, and the loading plate 400 are placed in the base 100, the top surface (e.g., first major surface 301) of the pellet plate 300 may be level or substantially level with the notch 123. The top surface (e.g., first major surface 401) of the loading plate 400 may be level, substantially level, or may extend beyond the outer edge of the wall 120.

Some clips include a central protrusion axially protruding from one or both faces of the clip. The base plate 110 may include indentations 113 for accepting protrusions on the clips.

Figure 4B:
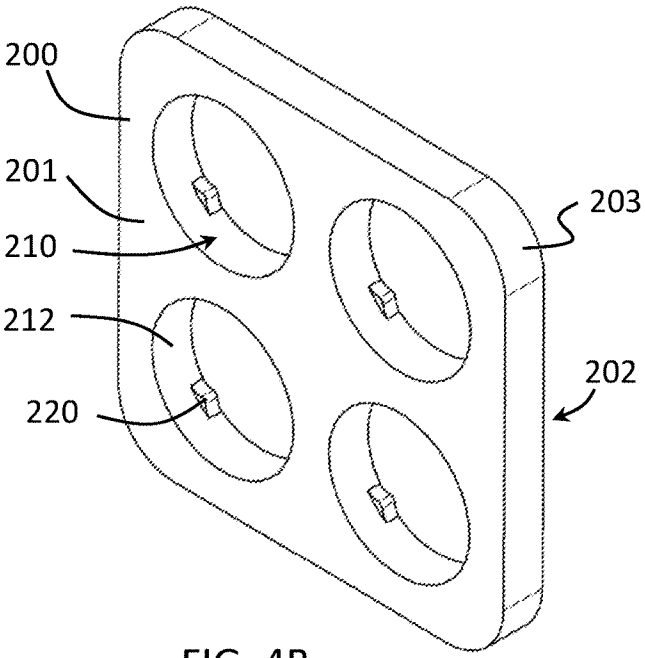
FIG. 4B is a side perspective view of the clip plate of FIG. 4A.
Figure 4A:
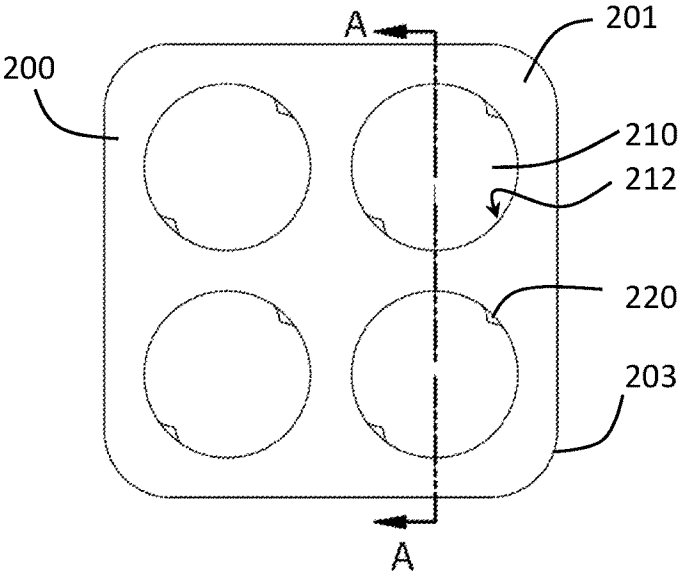
FIG. 4A is a plan view of a clip plate for the loader system of FIG. 1A according to an embodiment.
Figure 4C:
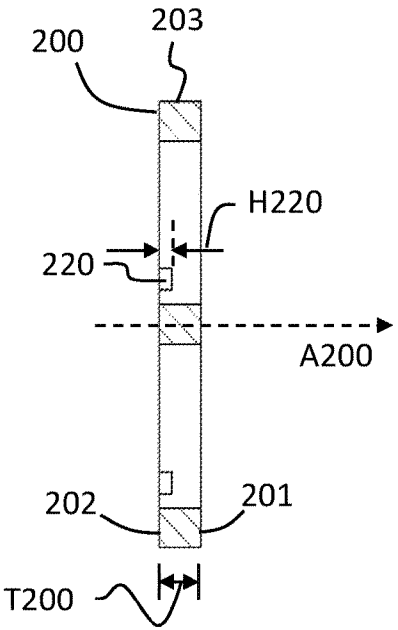
FIG. 4C is a cross-sectional side view of the clip plate of FIG. 4A.
Figure 5B:
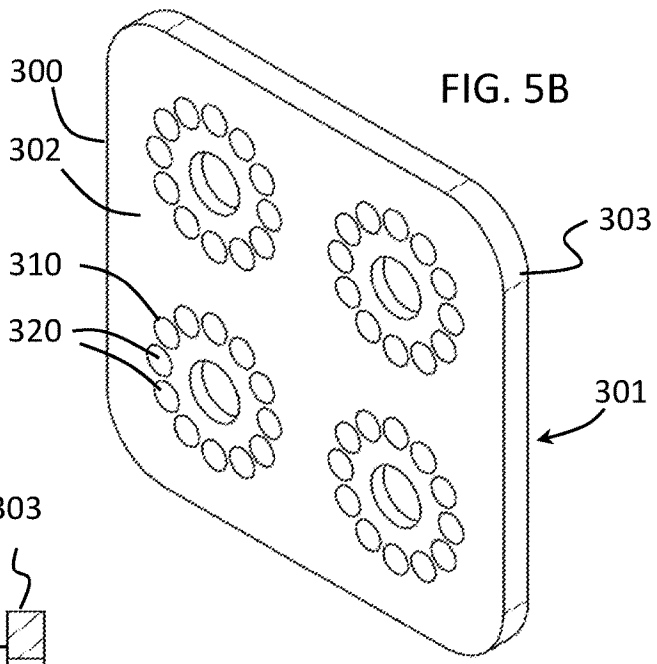
FIG. 5B is a side perspective view of the pellet plate of FIG. 5A.
Figure 5C:
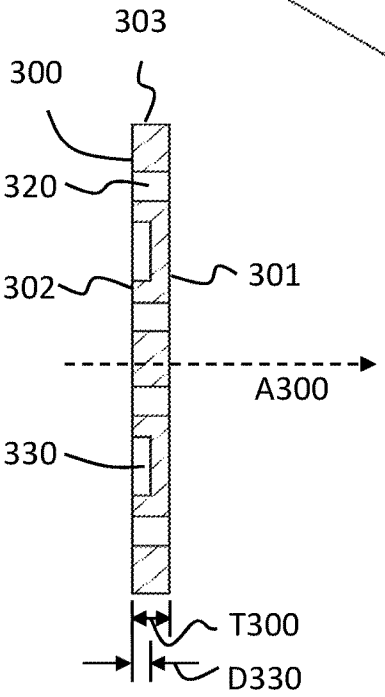
FIG. 5C is a cross-sectional side view of the pellet plate of FIG. 5A.
Figure 5A:
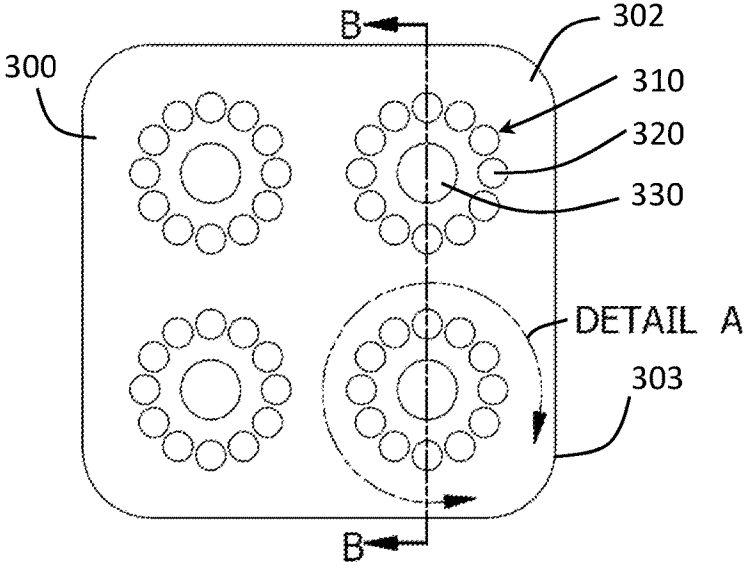
FIG. 5A is a plan view of a pellet plate for the loader system of FIG. 1A according to an embodiment.
Figure 5D:
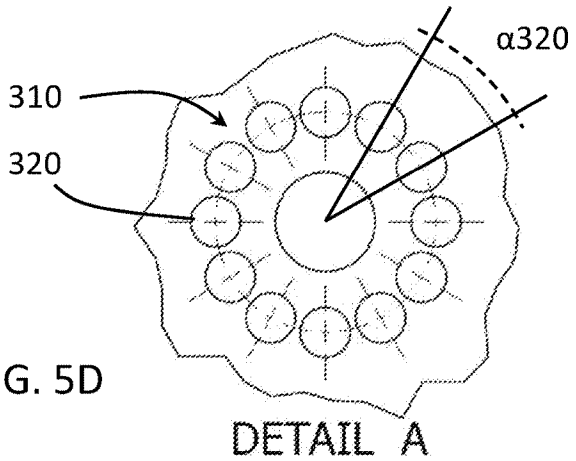
FIG. 5D is a detail view of the pellet plate of FIG. 5A.
Figure 6B:
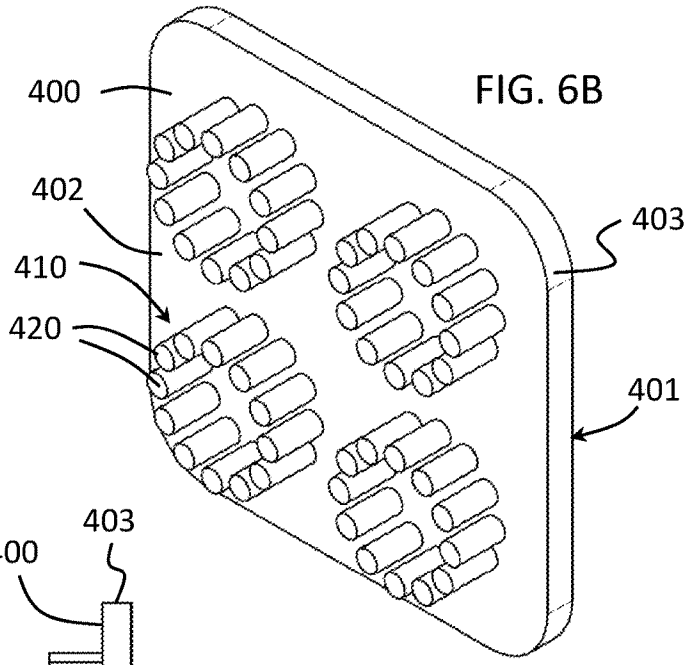
FIG. 6B is a side perspective view of the loading plate of FIG. 6A.
Figure 6C:
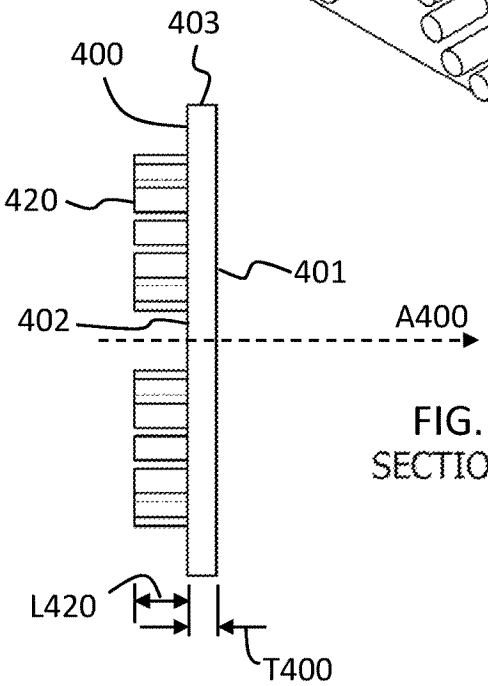
FIG. 6C is a cross-sectional side view of the loading plate of FIG. 6A.
Figure 6A:
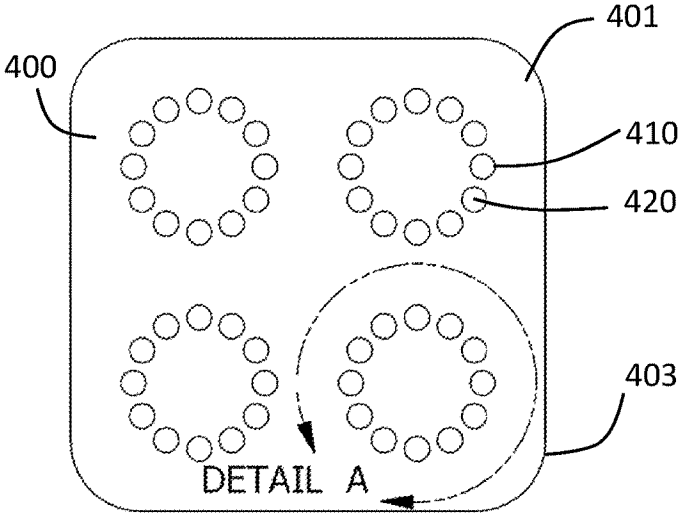
FIG. 6A is a plan view of a loading plate for the loader system of FIG. 1A according to an embodiment.
Figure 6D:
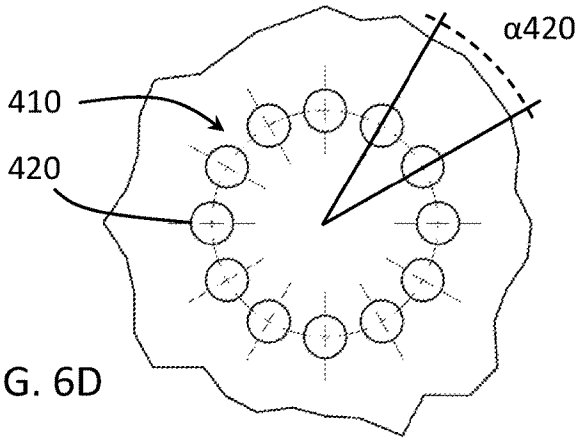
FIG. 6D is a detail view of the loading plate of FIG. 6A.

The clip plate 200 is shown in FIGS. 4A-4C as a separate piece. However, the clip plate 200 may be provided as an integral part of the base 100. The clip plate 200 includes one or more clip openings 210. The clip opening 210 is preferably a through hole extending through the thickness of the clip plate 200. Any suitable number of clip openings 210 may be selected. For example, the clip plate 200 may include one, two, three, four, five, six, or even more than six clip openings 210. Each clip opening 210 is constructed to accept a single clip.

The clip opening 210 includes one or more alignment features 220. The embodiment shown has two alignment features 220. However, any suitable number of alignment features 220 may be used. For example, the clip opening 210 may include a single alignment feature 220 or up to the number of pockets in the clip (e.g., up to eight alignment features 220 for a system intended for use with an eight-round clip). The one or more alignment features 220 may be positioned along the wall 212 of the clip opening 210. The alignment features 220 cause the clip to be received and to remain in a rotationally fixed alignment inside the clip opening 210.

The one or more alignment features 220 may have any suitable shape that is capable of maintaining the clip in a rotationally fixed alignment. The alignment feature 220 may be a protrusion extending inwardly from the wall 212 of the clip opening 210. For example, the one or more alignment features 220 may be protrusions shaped to fit between two scallops on the clip. In the example shown, the one or more alignment features 220 are generally triangular in shape.

The clip plate 200 has a first major surface 201 (e.g., a top surface) and a second major surface 202 (e.g., a bottom surface). The first and second major surfaces 201, 202 extend to an outer perimeter 203 of the clip plate 200.

The clip plate 200 has a height or thickness T200 defined by the first and second major surfaces 201, 202. The alignment features 220 have a height H220. In some embodiments, the height H220 of the alignment features 220 is less than the thickness T200 of the clip plate 200. In some embodiments, the alignment features 220 extend from the second major surface 202 a part of the way toward the first major surface 201. The height H220 of the alignment features 220 may be selected based on the type of clip used so that the height H220 is no greater than the height of the indentations 31 between the pellet pockets 3 on the clip 2.

The pellet plate 300 is shown in FIGS. 5A-5D. The pellet plate 300 includes a plurality of pellet openings 320 arranged in one or more circles 310. The circles 310 of pellet openings 320 are aligned with the clip openings 210 of the clip plate 200 when the pellet plate 300 and clip plate are disposed in the base cavity 130. The pellet openings 320 are aligned so that when a clip is positioned in a corresponding clip opening 210 and aligned by the one or more alignment features 220, the pellet openings 320 align with the pellet pockets of the clip.

The pellet openings 320 are through holes extending through the thickness of the pellet plate 300. The number and location of circles 310 of pellet openings 320 is matched to the number of clip openings 210 on the clip plate 200. For example, the pellet plate 300 may include one, two, three, four, five, six, or even more than six circles 310 of pellet openings 320. Each circle 310 of pellet openings 320 is constructed to match the pellet pockets of a single clip. In some examples, each circle 310 includes 6, 8, 10, 12, 14, or 16 pellet openings 320. Other numbers are also possible.

The pellet openings 320 may be sized to accommodate a clip for a specific caliber gun. The pellet openings 320 may be sized to accommodate pellets being greater than or equal to about 0.103 caliber, greater than or equal to about 0.172 caliber, greater than or equal to about 0.20 caliber, greater than or equal to about 0.224 caliber, greater than or equal to about 0.25 caliber, greater than or equal to about 0.308 caliber, greater than or equal to about 0.338 caliber, greater than or equal to about 0.40 caliber, greater than or equal to about 0.5 caliber, etc. and/or less than or equal to about 0.80 caliber, less than or equal to about 0.58 caliber, less than or equal to about 0.50 caliber, less than or equal to about 0.45 caliber, less than or equal to about 0.357 caliber, less than or equal to about 0.243 caliber, less than or equal to about 0.22 caliber, etc. In one exemplary embodiment, the pellet openings 320 are sized to accommodate 0.170 to 0.22 caliber shot (e.g., 0.170 to 0.180 caliber, also referred to as BB shot, or 0.20 to 0.21 caliber, also referred to as T shot).

The pellet plate 300 has a first major surface 301 (e.g., a top surface) and a second major surface 302 (e.g., a bottom surface). The first and second major surfaces 301, 302 extend to an outer perimeter 303 of the pellet plate 300.

The pellet plate 300 has a height or thickness T300 defined by the first and second major surfaces 301, 302. The pellet plate 300 may include indentations 330 for accepting a protrusion on the clip. The indentations 330 are centered within each circle 310 of pellet openings 320. The indentations 330 may have a depth D330 that accommodates the clip intended to be used in the loader 1. The indentations 330 may have a depth D330 that is less than the thickness T300 of the pellet plate 300.

The loading plate 400 is shown in FIGS. 6A-6D. The loading plate 400 includes a plurality of loading pegs 420 arranged in one or more circles 410. The circles 410 of loading pegs 420 are aligned with the pellet openings 320 of the pellet plate 300 when the loading plate 400 and pellet plate 300 are disposed in the base cavity 130. The loading pegs 420 are aligned so that when a clip is positioned in a corresponding clip opening 210 and aligned by the one or more alignment features 220, the loading pegs 420 align with the pellet openings 320 and the pellet pockets of the clip. In the exemplary embodiment shown, the pellet plate 300 has 12 pellet openings 320, the centers of the pellet openings 320 being separated by an angle $\alpha$320 of 30°, and the loading plate 400 has 12 loading pegs 420, also separated by an angle $\alpha$420 of 30°.

The number and location of circles 410 of loading pegs 420 is matched to the number of clip openings 210 on the clip plate 200. For example, the loading plate 400 may include one, two, three, four, five, six, or even more than six circles 410 of loading pegs 420. Each circle 410 of loading pegs 420 is constructed to match the pellet pockets of a single clip. For example, the number and size of, and distance between loading pegs 420 is constructed to match the pellet pockets of the clip. In some examples, each circle 410 includes 6, 8, 10, 12, 14, or 16 loading pegs 420. Other numbers are also possible.

The loading plate 400 has a first major surface 401 (e.g., a top surface) and a second major surface 402 (e.g., a bottom surface). The first and second major surfaces 401, 402 extend to an outer perimeter 403 of the loading plate 400. The loading pegs 420 extend from the second major surface 402 and are perpendicular or substantially perpendicular to the second major surface 402.

The loading plate 400 has a height or thickness T400. The thickness T400 is understood as the thickness of the plate to which the loading pegs 420 are attached and does not include the length of the loading pegs 420.

The loading pegs 420 have a length L420 extending axially from the second major surface 402 of the loading plate 400. The length L420 is such that then the loading plate 400 is stacked on the pellet plate 300 (e.g., when the loading plate 400 and pellet plate 300 are disposed in the base cavity 130), the loading pegs 420 extend through the pellet openings 320 and through the thickness of the pellet plate 300. In some embodiments, the length L420 is at least equal to the thickness T300 of the pellet plate 300. In some embodiments, the length L420 is greater than the thickness T300 of the pellet plate 300. The loading pegs 420 may extend through the pellet openings 320 and into the clip openings 210 when stacked on the pellet plate 300 and the clip plate 200. For example, the loading pegs 420 may extend from about 1 mm to about 10 mm, or from about 2 mm to about 6 mm beyond the thickness T300 of the pellet plate 300.

Each of the base plate 110, the clip plate 200, the pellet plate 300, and the loading plate 400 has a center axis A110, A200, A300, A400 extending perpendicular through the plane of the plate. When the clip plate 200, the pellet plate 300, and the loading plate 400 are stacked in the base cavity 130, the center axis A110, A200, A300, A400 (collectively axis A, as shown in FIGS. 1A and 1B) are coaxially aligned.

In a preferred embodiment, the clip plate 200, the pellet plate 300, and the loading plate 400 can be placed in the base 100 in any axial orientation. The clip plate 200, the pellet plate 300, and the loading plate 400 may each include one or more lines of symmetry. In some embodiments the alignment features 220 of the clip plate 200 are not symmetrical. In such embodiments, the clip plate 200 may include one or more lines of symmetry when viewed without the alignment features 220. The plates may be placed in the cavity 130 in more than one axially rotational alignment or position. The plates may be axially rotated from one line of symmetry to another line of symmetry when placing the plates into the cavity 130. For example, in the embodiment shown, the plates may be independently rotated 90°, 180°, or 270° about their center axis. Each plate may be individually rotated such that the orientation in which the plate is placed in the cavity does not depend on the orientation of the other plates or the orientation of the base.

The clip plate 200, the pellet plate 300, and the loading plate 400 may be considered self-aligning. The term "self-aligning" is used here to refer to an element that does not include alignment features (e.g., protrusions, indentations, or the like) to find its aligned position. An alignment feature is considered to be a feature (e.g., a protrusion or an indentation) that, if removed (e.g., cut off or filled), would leave the primary shape of the article intact. According to an embodiment, the outer perimeters 203, 303, 403 of the clip plate 200, pellet plate 300, and loading plate 400 are free of alignment protrusions or alignment indentations.

According to an embodiment, the inside surface 121 of the base wall 120 is also free of alignment protrusions or alignment indentations. It should be noted that the notch 123 in the wall 120 of the base 100 is not considered an alignment feature because the clip plate 200, the pellet plate 300, and/or the loading plate 400 do not extend into the notch 123 and are not aligned by the notch 123 when placed in the base 100.

The clip plate 200, the pellet plate 300, and the loading plate 400 may have a polygonal or rounded polygonal shape (e.g., primary shape) when viewed from a direction normal to the first or second major surface. In other words, the first and second major surfaces of each or the plates 200, 300, 400 may define a polygonal or rounded polygonal shape. In the example shown, the first and second major surfaces of each or the plates 200, 300, 400 define a rounded square shape. Other polygonal shapes include triangle, rectangle, pentagon, hexagon, heptagon, octagon, etc. In one embodiment, the shape is not a circle. In some embodiments, the outer perimeter 203, 303, 403 defines a smooth surface. In some embodiments, the outer perimeter 203, 303, 403 defines a continuous surface that is free of protrusions or indentations.

The inside surface 121 of the base wall 120 is constructed to accommodate the shape of the clip plate 200, the pellet plate 300, and the loading plate 400. Thus, the inside surface 121 of the base wall 120 may define a polygonal or rounded polygonal shape when viewed from a direction normal to the base plate. In the example shown, the inside surface 121 of the base wall 120 defines a rounded square shape when viewed from a direction normal to the base plate.

When the clip plate 200, the pellet plate 300, and the loading plate 400 are stacked in the base cavity 130, the second major surface 201 of the clip plate 200 faces the base plate 110, the second major surface 302 of the pellet plate 300 faces the first major surface 201 of the clip plate 200, and the second major surface 402 of the loading plate 400 faces the first major surface 301 of the pellet plate 300.

When the clip plate 200, the pellet plate 300, and the loading plate 400 are stacked in the base 100, at least the clip plate 200 and the pellet plate 300 are fully disposed inside the cavity 130. The loading plate 400 may be at least partially disposed inside the cavity 130 or a part of the loading plate 400 may extend outside of the cavity 130 beyond the wall 120.

In order to load ammunition (e.g., pellets) into clips, a user places the clip plate 200 into the base 100 (this step is skipped if the clip plate is integral with the base 100). The user then loads one or more clips into the clip plate, up to the number of clip openings 210 in the clip plate 200. The clips should be oriented with the loading side up. The user then places the pellet plate 300 into the base 100. When the pellet plate 300 is placed in the base 100, at least a portion of the base wall 120 extends beyond the pellet plate 300, providing at least a partial wall around the space above the pellet plate 300. The user may place (e.g., pour) pellets onto the pellet plate 300. The number of pellets may be at least equal to the total number of pellet pockets on the clips. The user may shake or move the base 100 sideways, causing pellets to fall into the pellet openings 320 of the pellet plate 300. Falling into the pellet openings 320 may be further aided by using a finger or a tool. Once the pellet openings 320 are loaded with pellets, any excess pellets possibly remaining on the pellet plate 300 may be removed. For example, excess pellets may be removed by pouring through the notch 123 in the base wall 120. The pellets are then loaded into the clips by pressing the loading plate 400 into the base 100 with the loading pegs 420 facing toward the pellet plate 300. The loading pegs 420 are aligned with the pellet opening 320 and extend into the pellet openings 320, pushing the pellets into the pockets of the clips. The loader 100 can then be disassembled and the loaded clips removed. The loader 100 may also be used to store the loaded clips for later use.

Various modifications and alterations to this disclosure will become apparent to those skilled in the art without departing from the scope and spirit of this disclosure. It should be understood that this disclosure is not intended to be unduly limited by the illustrative embodiments and examples set forth herein and that such examples and embodiments are presented by way of example only with the scope of the disclosure intended to be limited only by the claims set forth here.

The invention claimed is:

1. A system for loading clips, the system comprising:

a clip plate defining a plurality of clip openings and an alignment feature within each clip opening constructed to receive a clip in a fixed alignment;

a pellet plate defining pellet openings arranged in a plurality of circles aligned with the plurality of clip openings of the clip plate;

a loading plate comprising loading pegs aligned with the pellet openings of the pellet plate;

a center axis extending through the clip plate, the pellet plate, and the loading plate when in a stacked configuration; and a base comprising a base plate surrounded by a base wall, the base plate and base wall defining a base cavity constructed to accept the clip plate, the pellet plate, and the loading plate in more than one axial orientation.

2. The system of claim 1, wherein the clip plate, the pellet plate, and the loading plate are self-aligning.

3. The system of claim 1, wherein the base wall comprises an inside surface circumscribing the base wall, and where in the inside surface is free of alignment protrusions.

4. The system of claim 1, wherein each of the clip plate, pellet plate, and loading plate comprises a first major surface, a second major surface opposite of the first major surface, the first and second major surfaces extending to an outer circumference, wherein the outer circumference of one or more of the clip plate, pellet plate, and loading plate is free of alignment protrusions or alignment indentations.

5. The system of claim 1, wherein when the clip plate, pellet plate, and loading plate are stacked within the base cavity, the loading pegs extend through the pellet openings and into the clip openings.

6. The system of claim 1, wherein the base cavity has a height that is greater than a combined height of the clip plate and the pellet plate.

7. The system of claim 1, wherein the base wall comprises a notch, and the base wall has a first height at the notch and a second height adjacent the notch, the second height being greater than the first height, wherein the first height is approximately equal to a combined height of the clip plate and the pellet plate.

8. The system of claim 1, wherein the clip openings are constructed to accept 12-round clips of a pellet rifle.

9. The system of claim 1, wherein the clip openings are constructed to accept 8-round clips of a pellet rifle.

10. The system of claim 1, wherein the base cavity has a polygonal or rounded polygonal shape when viewed from a direction normal to the base plate.

11. The system of claim 1, wherein the base cavity has a square or rounded square shape when viewed from a direction normal to the base plate.

12. The system of claim 1, wherein each of the clip plate, pellet plate, and loading plate comprises a first major surface and a second major surface opposite of the first major surface, the first and second major surfaces defining a polygonal or rounded polygonal shape.

13. The system of claim 1, wherein each of the clip plate, pellet plate, and loading plate comprises a first major surface and a second major surface opposite of the first major surface, the first and second major surfaces defining a square or rounded square shape.

14. The system of claim 1, wherein one or more of the clip plate, pellet plate, and loading plate is symmetrical about a line parallel to the plate.

15. The system of claim 1, wherein the clip plate is integral with the base.

16. A method for loading clips, the method comprising: p1 placing one or more clips in clip openings of a clip plate within a base cavity, the clip comprising pockets;

placing a pellet plate on top of the clip plate within the base cavity, the pellet plate defining pellet openings aligned with the pockets of the clip;

loading pellets into the pellet openings; and pressing a loading plate into the base cavity, the loading plate comprising loading pegs that load the pellets into the pockets of the one or more clips, wherein a center axis extends through the clip plate, the pellet plate, and the loading plate when in a stacked configuration; and wherein the base cavity is constructed to accept the clip plate, the pellet plate, and the loading plate in more than one axial orientation.

* * * * *